US006512211B1

(12) United States Patent
Lockhart et al.

(10) Patent No.: US 6,512,211 B1
(45) **Date of Patent: *Jan. 28, 2003**

(54) STORAGE POUCH FOR USE WITH AN INDUCTION HEATER

(75) Inventors: Edward A. Lockhart, Norval (CA); Joseph S. Moyer, Chicago, IL (US)

(73) Assignees: Covertex Corporation, Brampton (CA); Thermal Solutions Inc., Wichita, KS (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/540,893

(22) Filed: Mar. 31, 2000

(51) Int. Cl.[7] ..... H05B 6/12

(52) U.S. Cl. ..... 219/621; 219/622; 219/624; 219/647; 219/387; 219/634; 99/DIG. 14

(58) Field of Search ..... 219/621, 622, 219/620, 624, 647, 649, 387, 634; 99/451, DIG. 14

(56) References Cited

U.S. PATENT DOCUMENTS

| | | | | | |
|---|---|---|---|---|---|
| 4,110,587 | A | * | 8/1978 | Souder, Jr. et al. | 219/622 |
| 4,816,646 | A | * | 3/1989 | Solomon et al. | 219/387 |
| 4,916,290 | A | * | 4/1990 | Hawkins | 219/387 |
| 5,155,319 | A | * | 10/1992 | Chiu | 219/622 |
| 5,603,858 | A | * | 2/1997 | Wyatt et al. | 219/620 |
| 5,611,328 | A | * | 3/1997 | McDermott | 126/246 |
| 5,892,202 | A | * | 4/1999 | Baldwin et al. | 219/387 |
| 6,018,143 | A | * | 1/2000 | Check | 219/387 |
| 6,232,585 | B1 | * | 5/2001 | Clothier et al. | 219/622 |

* cited by examiner

*Primary Examiner*—Philip H. Leung
(74) *Attorney, Agent, or Firm*—Ridout & Maybee LLP

(57) ABSTRACT

A pouch is provided for use in transporting packaged hot foodstuff such as pizza. The pouch has front and back walls, and a peripheral wall attached to the front and back walls. An induction heating element is retained in a location structure attached to the back wall for induction heating with the pouch positioned on a surface such that the wall carrying the heating element is on the surface. The element is then positioned relative to the surface for efficient induction heating to create a source of heat while the foodstuff is transported.

6 Claims, 2 Drawing Sheets

STORAGE POUCH FOR USE WITH AN INDUCTION HEATER

FIELD OF THE INVENTION

This invention relates to supplying packaged hot foodstuffs in a pouch, and more particularly to a pouch suitable for delivering hot pizza and similar products in a box.

BACKGROUND OF THE INVENTION

The invention will be described with reference to a pouch particularly suitable for delivery of boxed pizza. It will be appreciated that products requiring similar handling can be carried in a pouch incorporating the invention.

There are many pizza makers who offer the service of delivering hot pizza, which of course, must arrive hot and ready to be served. It has become common practice for a delivery person to use an insulated pouch to carry the pizza. The pouch is conveniently shaped to receive one or more pizzas. Clearly the time taken to deliver the pizza and the ambient conditions will have an effect on the temperature of the pizza. If the pizza is too cold, the pizza may be rejected and the sale lost. Consequently there is a need for a pouch which has sufficient stored heat to maintain the temperature of the pizza.

Several approaches have been tried involving the inclusion of some form of heating element. Each element must meet several criteria. Firstly, the element must be light enough to be carried in the pizza pouch. Also, the element will cool in use so it must be such that it can be reheated, preferably still in the pouch, so that it can be reused often frequently. The element must be inert, reliable, and be such that reheating can be one efficiently and reliably.

Some pouches have been made and used which have electrical heating elements. After each use the element is reheated using an electrical circuit provided for the purpose. Others have used bags containing a phase change material that has the potential advantage that, as the heat is given off the pizza, the phase changes and the temperature is maintained substantially constant until the phase change has been completed. Although materials are available for such a purpose, they generally include a liquid phase that leads to container problems as well as the possibility of leakage.

The present invention is intended to provide a pouch suitable for use in delivering products such as hot pizzas, and which does not suffer from the disadvantages of pouches found in the prior art.

SUMMARY OF THE INVENTION

A pouch is provided having front and back walls, and a peripheral wall attached to the front and back walls. An induction heating element is retained in a location structure attached to the back wall for induction heating with the pouch positioned on a surface such that the wall carrying the heating element is on the surface. The element is then positioned relative to the surface for efficient induction heating.

In another of its aspects, a pouch includes an induction heating element and structure locating the element in the pouch for efficient induction heating with the pouch placed in a preferred position on an induction heater.

BRIEF DESCRIPTION OF THE DRAWINGS

The invention will be better understood from the following description taken in combination with the drawings, in which.

DESCRIPTION OF THE PREFERRED EMBODIMENT(S)

Figure 1:
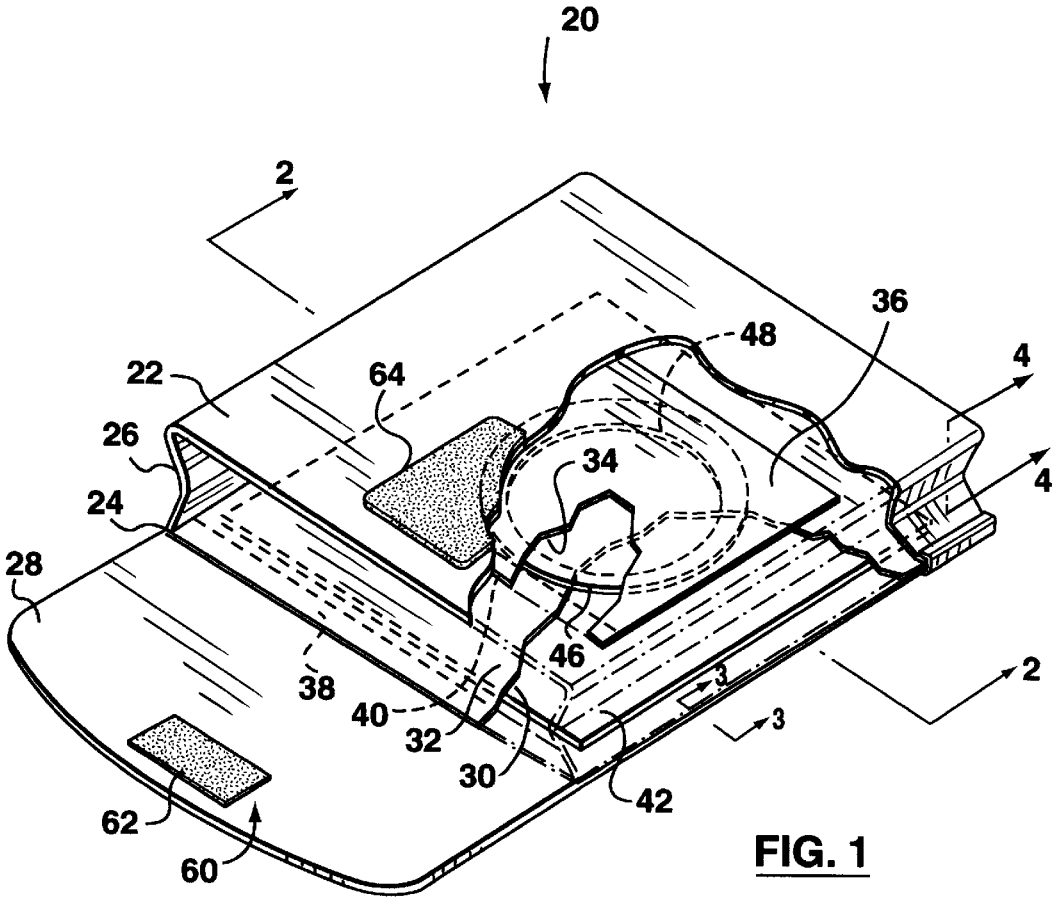
FIG. 1 is an isometric view of a pouch according to a preferred embodiment of the invention with portions broken away to show internal detail.

Reference is first made to FIG. 1 to describe the main parts of a pouch identified generally by the numeral 20. The pouch consists essentially of square front and back walls 22 and 24, a peripheral wall 26 which is attached to three of the sides of the front and back walls 22, 24, and a flap 28 which is an extension of the back wall 24. More details of the structure will be given later.

The back wall includes an outer pocket 30 formed by a first sheet 32 attached to the sides of the back wall at the junction with the peripheral wall 26, and an inner pocket 34 formed by a second sheet 36 attached to the sheet 32. The second sheet is smaller than the first sheet and is spaced centrally relative to the back wall 24.

The outer pocket 30 has a Velcro (registered trademark) closure indicated at 38 and the inner pocket has a similar closure indicated at 40.

The outer and inner pockets 30, 34 combine with a square rigid insert 42 positioned in the pocket 30 to form a location structure (indicated generally by the numeral 44 in FIG. 2) to locate an induction heating element 46. This element is in the form of a round disc and fits snugly in the inner pocket 34.

The rigid insert 42 is non-inductive and preferably made from acrylic in a honeycomb fashion both for lightness and also to withstand heat stored in the element 46.

A circular opening 48 is provided in the rigid insert 42. The opening 48 is slightly smaller than the diameter of the element 46 and is positioned to be concentric with the element and slightly smaller than the element. This opening 48 serves two purposes. Firstly it defines a cavity 50 (better seen in FIG. 2) to provide an air space to minimise direct heat transfer to the outside of the pouch, and it also supports the element 46 at a selected height when the pouch 20 is laid down flat supported by the back wall 24. Details of the arrangement can be seen in FIG. 2 which is a section on line 2—2 of FIG. 1 and is taken through the centres of the heating element and the opening in the insert.

Figure 2:
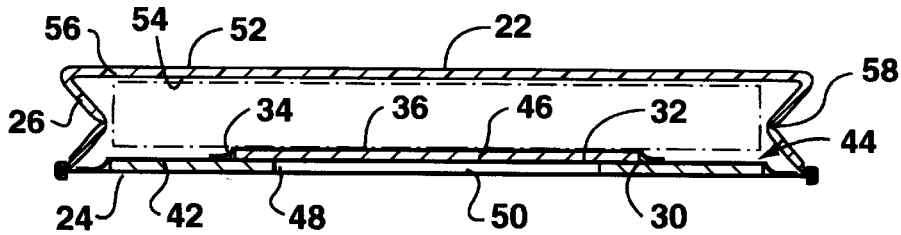
FIG. 2 is a sectional view of the pouch taken on line 2—2 of FIG. 1.

FIG. 2 also shows some details of construction. Basically the front wall 24 and the peripheral wall 26 consist of a woven nylon outer skin 52, a similar but lighter inner skin 54, and an insulating material 56 between the skins. The materials are chosen for long life and also to withstand the heat from the induction heating process. The back wall 26 is of similar material to skin 52 and the sheets 32, 36 are similar to the material of the inner skin 56.

As also seen in FIG. 2, the peripheral wall is stitched at 58 to provide a defined line for folding. The stitching and assembly are such that the wall tends to fold inwardly to collapse the pouch and bring the front and back walls towards one another. This is useful to minimise se the volume in the bag (and hence the heat loss) to accommodate one or more pizzas. The bag will to some extent self adjust to the thickness needed to accommodate the pizzas.

The pouch includes a Velcro closure 60 on the flap 28 to close the pouch. The closure has a first part 62 on the flap and a second larger part 64 on the front wall to accommodate the flap for different thicknesses of pizza stored in the pouch.

Figure 3:
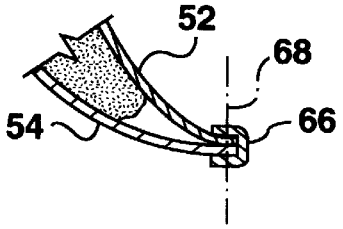
FIG. 3 is a sectional view to a larger scale and showing detail on section line 3—3 of FIG. 1.
Figure 4:
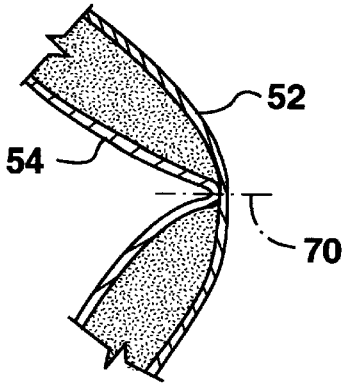
FIG. 4 is a view similar to FIG. 3 and taken on line 4—4 of FIG. 1.

As seen in FIG. 3, the outer and inner skins 52, 54 meet at a tape 66 which is doubled over the edges of the skins and sewed along a line indicated at 68. Similarly, and as seen in FIG. 4, the skins 52, 54 are sewed at the line 58 (previously mentioned with reference to FIG. 2.) to create the line of folding previously mentioned.

Figure 5:
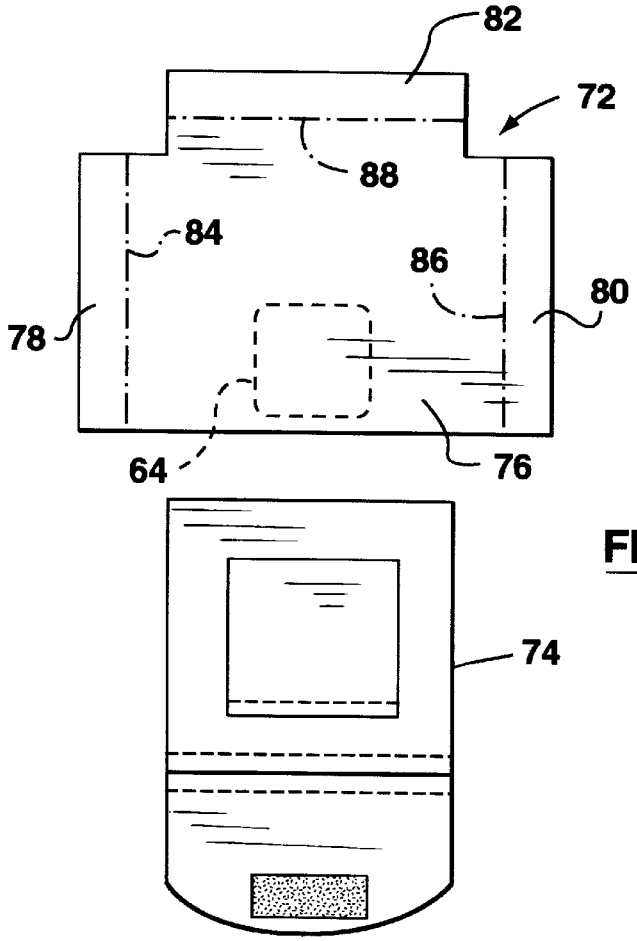
FIG. 5 is a top view of a blank used to make the pouch and shown partly assembled.

Reference is now made to FIG. 5 which shows a pair of blanks, 72 and 74 which will be sewed together to form the pouch. The blank 72 is essentially a square central part 76 bordered by flaps 78, 80, and 82. These flaps will form the peripheral wall 26 (FIG. 1) when assembled. Prior to such assembly, the flaps are stitched at 84, 86, and 88 respectively to form the lines of fold mentioned in FIG. 4. Also the second part 64 of the closure 60 (FIG. 1) is attached.

The blank 74 is also a partial assembly. The sheets 32 and 36 have been attached by sewing, and the closure first part 62 attached. A sewing line 92 is made in the flap 28 near the back wall 24 to better define how the flap folds into position on the front wall when the pouch is closed.

To assemble the blanks, the flaps 78, 82 and 80, 82 are stitched along adjacent edges with the outer skins in contact. The resulting structure is "inside out" and has to be reversed to bring the sewed edges inside the structure to present a clean outward appearance. The blanks are then brought together to be stitched along the line 68 (FIG. 3) as the tape 66 is applied.

The pouch is finished by inserting the rigid insert 42 (FIG. 1) and the induction heating element 46 and closing the closures 38 and 40 to retain the insert 42 and element 46 securely in the pouch 20. The pouch bag is then ready for use.

The induction heating element is preferably of a type using solid materials which remain solid as they change phase. One such element is available from Cooktek of Chicago, Ill. However any suitable inductive material which remains solid in use is suitable.

The pouch 20 allows the user to place the pouch 20 on the surface of an induction heater with the back wall 24 down on the surface. The location structure 44 will ensure that the heating element 46 in position for heating.

Variations from the structure described with reference to the preferred embodiment can be made within the scope of the invention, and such variations are intended to be within the scope of the claims.

What is claimed is:

1. A pouch for use in transporting packaged food such as hot pizza, the pouch having:

interconnected front and back walls;

a location structure attached to the back wall and including, an outer pocket attached to the back wall, a rigid insert in said outer pocket, the rigid insert having a central opening, and an inner pocket attached to the outer pocket;

an induction heating element retained in the inner pocket over said opening for induction heating with the pouch positioned in contact with the surface of an induction heater with the back wall on said surface so that the heating element is then positioned relative to the surface for efficient induction heating.

2. A pouch as claimed in claim 1 in which the heating element is a round disc.

3. A pouch as claimed in claim 1 wherein a peripheral wall is attached to the front and back walls.

4. A pouch as claimed in claim 3 in which the peripheral wall defines a stitch line to define a line of folding.

5. A pouch for use in transporting hot packaged food such as pizza, the pouch having:

square front and back walls interconnected at three sides thereof;

a closure flap attached to the back wall for folding over the front wall to close the pouch;

a first sheet attached to the inside of the back wall to define an outer pocket;

a rigid flat insert filling the outer pocket, the insert having a central opening defining a cavity;

a second sheet attached to the first sheet to define an inner pocket covering the opening; and an induction heating element fitted in the inner pocket for location in the pocket relative to the opening, whereby when the pouch is positioned with the back wall in contact with the surface of an induction heater, the heating element is positioned relative to said surface for efficient induction heating of the induction heating element to thereby store heat in the element.

6. A pouch as claimed in claim 5 wherein a peripheral wall is attached at the three sides of the square front and back walls.

* * * * *